United States Patent [19]

Goller et al.

[11] Patent Number: 4,554,802

[45] Date of Patent: Nov. 26, 1985

[54] ADJUSTMENT OF STITCH CAMS IN A KNITTING MACHINE

[75] Inventors: Ernst Goller, Reutlingen; Jürgen Ploppa, Pfullingen; Fritz Walker, Kusterdingen, all of Fed. Rep. of Germany

[73] Assignee: H. Stoll GmbH & Company, Fed. Rep. of Germany

[21] Appl. No.: 589,247

[22] Filed: Mar. 13, 1984

[30] Foreign Application Priority Data

Mar. 24, 1983 [DE] Fed. Rep. of Germany ..... 3310671

[51] Int. Cl.[4] ..... D04B 7/00; D04B 15/36

[52] U.S. Cl. ..... 66/71; 66/78; 66/75.2; 66/77

[58] Field of Search ..... 66/71, 77, 78, 75.2

[56] References Cited

U.S. PATENT DOCUMENTS 1,536,200 5/1925 Fels ..... 66/71
3,771,329 11/1973 Krause ..... 66/78
3,779,044 12/1973 Schieber et al. ..... 66/78

FOREIGN PATENT DOCUMENTS 2622883 12/1975 Fed. Rep. of Germany ..... 66/78
2622347 12/1976 Fed. Rep. of Germany ..... 66/78

*Primary Examiner*—Ronald Feldbaum
*Attorney, Agent, or Firm*—Jones, Tullar & Cooper

[57] ABSTRACT

A carriage 14 is reciprocable along a needle bed of a flat knitting machine and carries a needle cam. A pair of stitch cams 12 and 13 are adjustably supported by the carriage 14 and are disposed so as to trail behind the needle cam in alternate strokes of the carriage, respectively. An adjustment mechanism 11 includes a stepping motor 38 (FIG. 3) which adjusts the trailing stitch cam 12 or 13 not only at the beginning of the respective stroke but also during the course of the stroke itself, thereby enabling the stitch density to be varied within each row of the knitted article as well as from row to row.

19 Claims, 5 Drawing Figures

ADJUSTMENT OF STITCH CAMS IN A KNITTING MACHINE

This invention relates to the adjustment of stitch cams of a knitting machine, particularly a flat knitting machine.

Typically, a flat knitting machine comprises a needle bed along which a carriage moves through forward and return strokes, the carriage having a needle cam and a pair of stitch cams mounted thereon. An adjustment mechanism is provided for adjusting the stitch cams relative to the carriage immediately before the return stroke of the latter, such adjustment usually being performed by means of a stepping motor.

On most flat knitting machines of this kind which are in use at present, the adjusting mechanism is of purely mechanical design and includes various slides which are assigned to the stitch cams. These slides are actuated selectively at the stroke return point of the carriage, so that the setting of the stitch cam trailing behind the needle cam can be selected for operation. These purely mechanical adjusting mechanisms are unsatisfactory because, for reasons of design, they only provide a few setting possibilities for the stitch cams.

Recently, therefore, a change has been made to the use of adjusting mechanisms which utilise a stepping motor for setting the stitch cams at an essentially infinitely variable number of positions. This gives rise to a considerable increase in the number of different knitting styles which can be obtained owing to the number of different stitch densities which can be achieved. Examples of adjusting mechanisms of this type are disclosed in German OS No. 21 11 553 and German OS No. 21 53 429.

In the adjusting mechanism described in the last-named document, a stepping motor is rigidly connected to each stitch cam, which means that the stitch cam is switched off with the aid of the respective stepping motor and through this each stitch cam always has to be re-set. Switching off of the one stitch cam and switching on of the other stitch cam by adjusting the associated stepping motor occurs at the point of carriage return, i.e. immediately before the return stroke before the actual knitting operation, as with the previously-described mechanical adjusting mechanisms. A time problem therefore arises, along with a problem regarding the reproducibility of the setting of the stitch cams.

In the adjusting mechanism described in the first-named document, a lift-off device is provided by means of which the stitch cam not in operation, along with its associated adjusting mechanism including the stepping motor, is lifted from the needle bed. With this construction, the time problem mentioned above is avoided because the setting and adjustment of the stitch cam can be done during the carriage stroke in the raised, non-working position. As before, however, at the return point of the carriage stroke, that is before the actual knitting operation, the adjusting mechanism (together with the stitch cam which has been brought into its pre-selected position) is brought towards the needles, i.e. into operation. In both of the above constructions, a separate stepping motor is assigned to each stitch cam and is disposed such that its adjusting movement acts in the direction of displacement of the stitch cam.

In German OS No. 26 22 883 there is disclosed an adjusting mechanism in which the two stitch cams, which are directed slopingly towards one another, can be actuated by a horizontally movable cam slide rod, the rod having a toothed rack end which can be driven by a stepping motor. Using such a cam rod, it is possible not only to bring the stitch cams into and out of action, but also to achieve height adjustment of the stitch cams within certain limits. Movement of the cam slide rod occurs at the point of return of the carriage stroke. Since the cam rod not only exerts a movement in an adjusting direction on these stitch cams but also produces a movement component perpendicularly to this, and since the height adjustment of the stitch cams is done by the cam rod without their being lifted up, a very strong stepping motor is needed which is disadvantageous both from the point of view of cost and also in respect of the weight which must be moved by the carriage. A further disadvantage of this adjusting mechanism results from the fact that, at each carriage return point, height adjustment for the stitch cams has to be re-executed because the previous height adjustment is lost when one or other of the stitch cams is brought into or out of action. This results not only in a setting which is difficult to reproduce but also in a considerable amount of time being needed for the setting.

In all of the above-mentioned conventional adjusting mechanisms, the stitch cam is preselected in its non-working position and is only brought into the operating position at the carriage return point, there being no further adjustment during the carriage stroke. This means that the stitch density cannot be altered within the rows themselves and each row must therefore have a uniform stitch density.

It is an object of the present invention to avoid this negative effect and to provide an adjusting mechanism in which it is possible to vary the stitch density not only in the longitudinal direction but also transversely of the piece of knitting.

According to the present invention, there is provided a knitting machine comprising a needle bed, a carriage reciprocable along the needle bed and having a needle cam mounted thereon, a pair of stitch cams adjustably supported on the carriage and being disposed so as to trail behind the needle cam during alternate strokes of the carriage, respectively, and an adjusting mechanism including a stepping motor operative to adjust the trailing stitch cam relative to the carriage not only at the beginning of the respective stroke but also during the actual stroke itself.

Since the relevant stitch cam can be adjusted during the actual stroke of the carriage as well as at the return point thereof, it is possible to vary the stitch density of the piece of knitting in a transverse direction as well as in the direction of knitting. This makes it possible to produce pieces of knitting in variety because the setting of the stitch cams can be varied for each individual stitch within each row.

Although it is known from Swiss Patent Specification No. 465 117 to adjust the stitch cams additionally during the carriage stroke with the aid of a mechanical adjusting mechanism, this is done by means of relatively complicated and expensive guide bars provided with adjustable cam carriers on which a lever device acts, the lever device being connected to sliding elements of the stitch cams. Nevertheless, even using this known type of mechanical adjusting mechanism, it is not possible to provide varying combinations of knitting density in the individual rows because the carriers give the same stitch density in each row once they have been set. A certain increase in the variety of the pieces of knitting can indeed be achieved, but only to a relatively limited extent. For this reason, this type of mechanical adjusting mechanism has not been taken up very widely in practice.

In a preferred example of the adjusting mechanism, each of the stitch cams is guided by means of a guide peg which is slidably engaged in a guide slot, this slot being inclined to the axis of the carriage. The guide pegs abut against an adjusting ledge under the action of a tension spring, the adjusting ledge being driven by the stepping motor in a direction inclined to the direction of the guide carriage. The guide pegs are connected to a guide lever in such a manner that they can swivel, the other end of the guide lever being held so that it can swivel on an axle disposed parallel to the guide peg and fixed to the lever. In this way, even when both of the stitch cams are driven by a common stepping motor, it is possible to carry out a height adjustment in a condition wherein the motor is loaded with at least one of the stitch cams. The guide lever takes up the motive force component transversely of the guide slot, so that tilting and friction which considerably affect the design of the stepping motor are avoided. It is thus no problem to adjust the stitch cam in question quickly and accurately even during the stroke of the carriage and to knit simultaneously with this new setting.

The guide lever is desirably disposed on a side of the guide peg which faces away from the adjusting ledge, whereby the adjusting ledge can be moved vertically.

A simple design is made available if two adjusting ledges are provided which can be moved parallel to one another, these ledges being acted upon by a common driving element disposed there-between and connected to the stepping motor. With such an arrangement, with the height setting remaining the same during forward and return strokes, the adjustment of both adjusting ledges can take place by means of a single adjustment operation.

In order to achieve height adjustment of the stitch cams which is as accurate as possible, which is predetermined and which is reproducible, the driving element can be positively connected without great play to an internally threaded bushing, the bushing being engaged with a spindle shaft of the stepping motor for movement therealong. This can be achieved by providing the driving element with a slide part which is movable towards the outer periphery of the bushing, the slide part being thus movable by means of an eccentric member extending perpendicularly to the direction of sliding. In this manner, by rotating the eccentric member to slide part is pressed against the bushing, creating a friction lock which prevents any play which might otherwise influence the adjusting precision of the driving element.

In order to adapt the adjusting mechanism to differing sizes of needle, an intermediate member may be held in interchangeable fashion between the driving element and the adjusting ledges. By changing this intermediate member, a parallel displacement of the zero setting of the adjusting mechanism is produced which does not however necessitate the same sort of change in the motor and switch setting. In this way, the average adjustment time required for the stitch cams remains unextended, and yet an adjustment or adaptation to the fineness of the knitting machine is possible.

In order to be able to balance out the mechanical tolerances inherent in the machine, a correction member firmly connected to the driving element can be disposed between the driving element and the adjusting ledges. This connection member is selected as a function of the mechanical tolerance on the one hand of the adjusting mechanism and on the other hand of the fixing on the carriage in relation to the stitch cams.

To fix the zero point in a lower-most position of the driving element, a stop device can be provided which comprises two stop elements movable relative to one another, these elements being able to come up against each other in a peripheral direction. This prevents the bushing from hitting against an axial stop, which would have the effect of leading to automatic locking which could not be released again by the stepping motor without considerable difficulty. The setting here can be such that a peg projecting radially from the spindle goes just past a pin projecting axially from the bushing in the penultimate revolution, while in the next revolution it hits against this pin because the projection arrives in the peripheral path of the latter.

A limitation can also be provided on the upward travel of the bushing in a similar way to the lower travel limitation or zero point setting mentioned above. For example, the bushing can be moved against a pressure spring which compresses when the bushing becomes unthreaded from the spindle shaft. In other words, as soon as the bushing compresses the pressure spring, it disengages from the external thread on the spindle shaft so that no further axial adjustment occurs. Nevertheless, if the stepping motor is turned back, the two threads can interlock again because the pressure spring presses the bushing against the threaded part of the spindle shaft.

The invention will now be further described, by way of example only, with reference to the accompanying drawings, in which.

Figure 1:
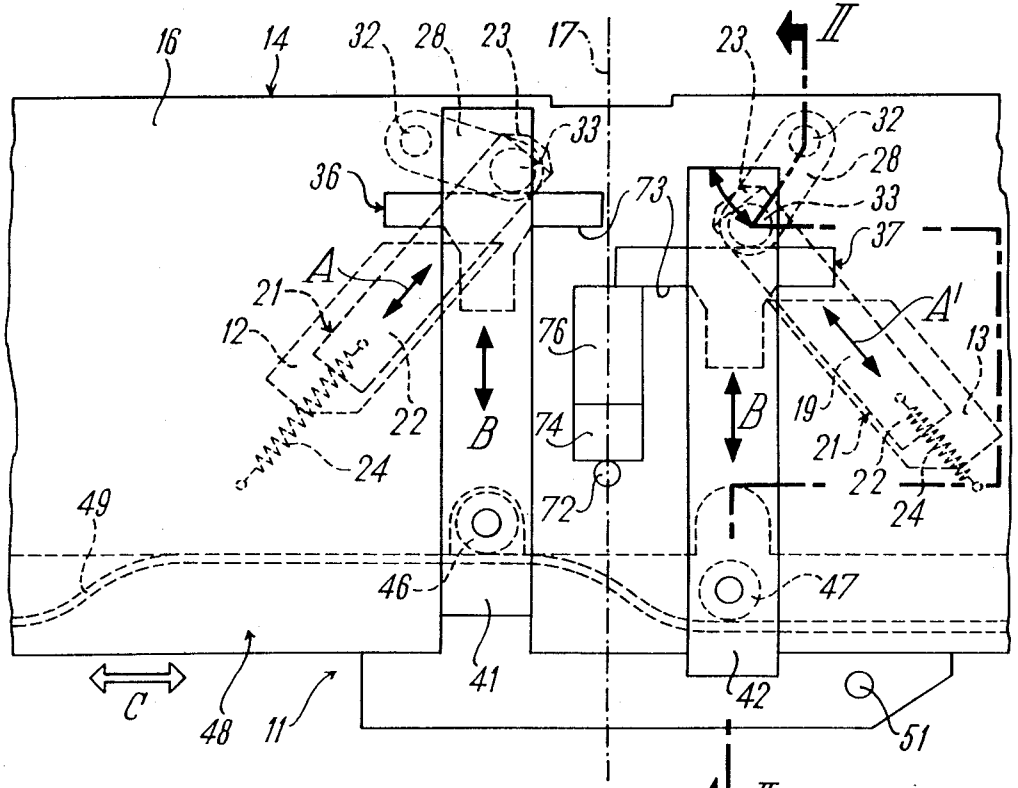
FIG. 1 is a plan view of a carriage of a knitting machine according to the present invention, the carriage supporting two stitch cams and an adjusting mechanism therefor.

FIG. 1 shows a carriage 14 which is reciprocable along a needle bed (not shown) of a flat knitting machine, the carriage 14 supporting a needle cam (also not shown) and a pair of stitch cams 12 and 13 which can be adjusted by means of an adjusting mechanism 11. As will be explained in detail later on, the adjusting mechanism 11 is constructed so that whichever one of the stitch cams 12 and 13 trails behind the needle cam in a given stroke of the carriage, it can be adjusted in height during the actual carriage stroke. This enables the closeness of the individual stitches to be selected differently not only from row to row in the knitted article, but also from stitch to stitch in each row, and at the same time the knitting can be made correspondingly more or less close.

Figure 2:
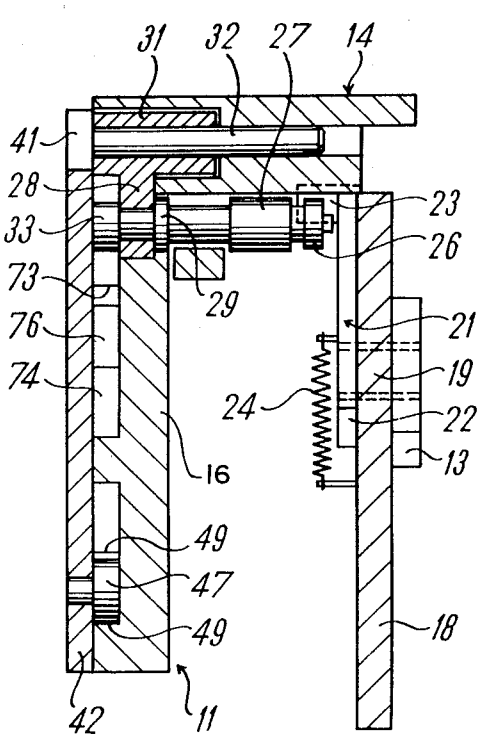
FIG. 2 is a section taken along the line II—II in FIG. 1.

Of the carriage 14, FIG. 1 shows essentially only an upper or front plate 16 which faces away from the needle bed, on which plate are fixed the individual elements of the adjusting mechanism 11, the stitch cams 12 and 13 being disposed in a plane behind this (see FIG. 2). Other than this, the carriage 14 and the plate 16 are shown only to the extent necessary to illustrate the stitch cams 12 and 13 with the adjusting mechanism 11.

The two stitch cams 12 and 13 are disposed in a conventional way symmetrically relative to an imaginary longitudinal center plane 17 of the needle cam, in such a way that they are inclined towards one another. The stitch cams 12 and 13 are held on a rear side of a lower or rear plate 18, and are movable along respective inclined guideways 19 in the direction indicated by double-headed arrows A and A'. As can be seen in FIG. 2, each stitch cam is attached to an approximately L-shaped carrying member 21 which is also able to move in the direction of the arrow A or A'. The carrier member 21 lies with a long arm 22 thereof on the front end of the back plate 18, i.e. opposite the needle lowering device which is connected through the back plate 18 to the carrier member 21. The stitch cam or the carrier member 21 associated therewith is connected to one end of a tension spring 24, the other end of which is secured to a fixed part, for instance the back plate 18. The spring 24 extends in the direction of the arrow A or A', and thus endeavours to pull the stitch cam 12 or 13 into a lowermost position.

Under the action of the tension spring 24, a short arm 23 of the carrier member 21 abuts against a radial ball bearing 26 which is fixed on the back end of a guide peg 27. The peg 27 extends in a direction perpendicular to the stitch cam 12 or 13 between the plates 16 and 18. In an end area facing towards the front plate 16, the guide peg 27 is pivotably mounted on one end of a guide lever 28, whereby the guide lever 28 is penetrated by the guide peg 27 and abuts against a rear flange 29 of the peg 27. The other end of the guide lever 28 has an elongated bearing bushing 31 which is pivotably mounted on a fixed axle 32 extending parallel to the guide peg 27.

The front end of each guide peg 27 abuts via a radial ball bearing 33 against one of two adjusting ledges 36 and 37 which, with the aid of a common stepping motor 38 (see FIG. 3), can be reciprocated in a vertical direction as indicated by double-headed arrow B. The adjusting ledges 36 and 37 are attached respectively to a pair of slides 41 and 42 which extend parallel to each other and which are each guided for movement along a slot 43 in a respective guide plate 44, 45 of a driving unit 39 which contains the stepping motor 38. Each slide 41, 42 is fitted with a roller 46, 47 on an end thereof which faces away from the adjusting ledge 36, 37. This roller co-operates with an adjusting slide 48 which extends perpendicularly thereto and which is provided with a cam plate 49. The adjusting slide 48, which can be moved backwards and forwards in the direction of the double-headed arrow C, determines whether and which of the stitch cams 12 and 13 comes into action. In FIG. 1, the left-hand stitch cam 12 is depicted as being out of action because it is pushed by the guide peg 27 and the adjusting ledge 36 into an uppermost, non-working position: in contrast, the right-hand stitch cam 13 is shown as being ready to operate. The adjusting slide 48 can however also be positioned such that both of the stitch cams 12 and 13 are out of action, which is the case when the rollers 46, 47 of both slides 41, 42 are pushed upwards by the adjusting slide 48. The return of the slides 41 and 42 when released by the adjusting slide 48 occurs under the action of the respective tension springs 24 acting on the carrier members 21.

Figure 4:
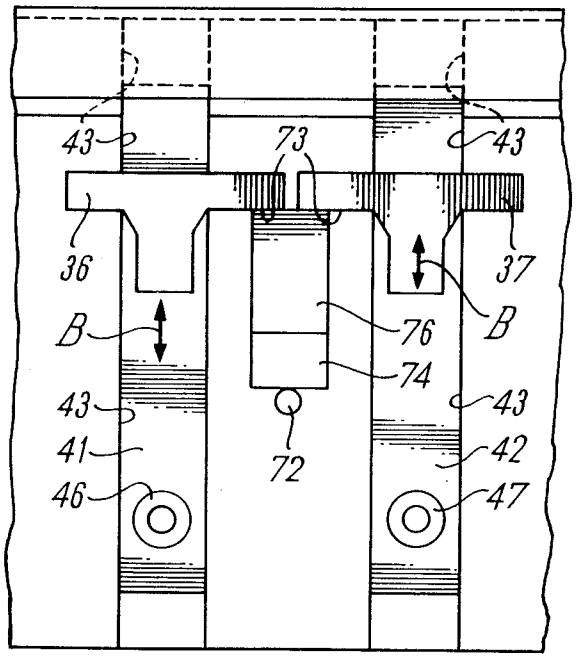
FIG. 4 is a view along arrow IV in FIG. 3.
Figure 3:
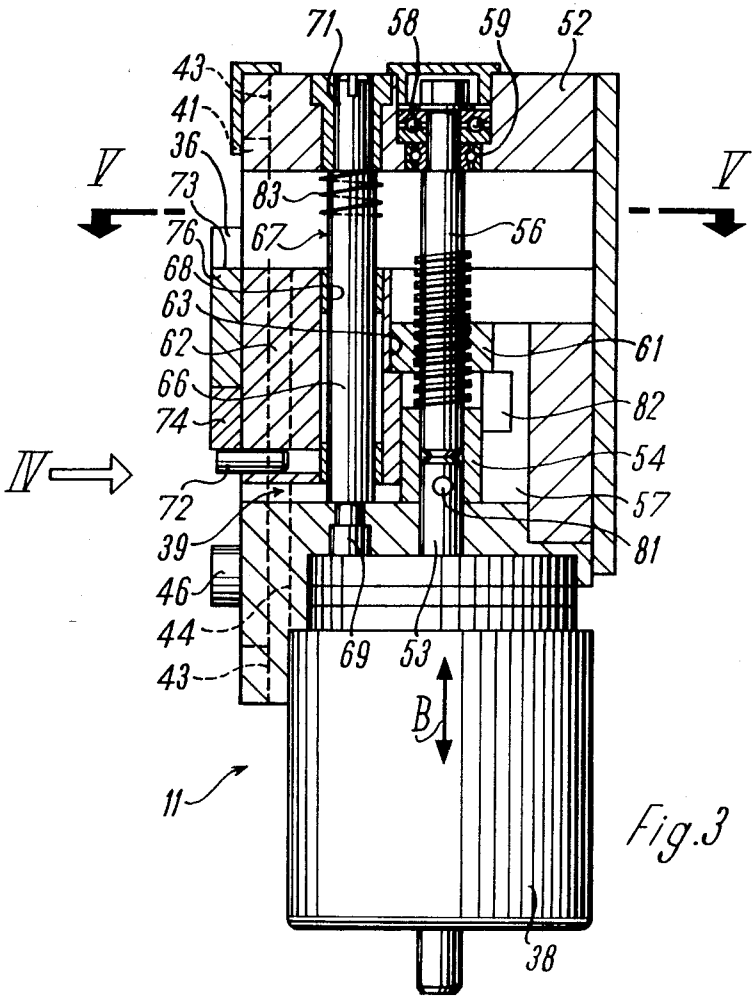
FIG. 3 is a longitudinal section through the adjusting mechanism, the section being taken in a plane at right angles to that of FIG. 1.

The driving unit 39 will not be described with reference to FIGS. 3 to 5. The driving unit 39 is secured along with the guide plates 44 and 45 on the front plate 16 of the carriage 14, being fixed by means of a fitting pin 51. The plate 44 is secured on a housing 52 on whose lower end the stepping motor 38 is flange-mounted (see FIG. 3) a drive shaft 53 of the motor 38 being firmly attached to a threaded spindle 56 by way of connecting sleeve 54 so that it cannot rotate and is fixed in the axial direction. The threaded spindle 56 penetrates through an axial recess 57 in the housing 52 and is rotatably mounted on an end of the housing 52 remote from the motor 38 by means of a radial bearing 58 and a thrust bearing 59.

A threaded bushing 61 is mounted on the spindle 56 and is held against rotation in the peripheral direction, so that it can be moved to and fro in an axial direction (as indicated by the double-headed arrow B) by rotation of the spindle 56. To prevent rotation thereof, the bushing 61 is positively connected, e.g. by a frictional locking as will be described later, to a connecting element 62 which is held so that it cannot be rotated but can slide a little in a transverse direction. Such positive connection is achieved by engagement of the outer circumference of the bushing 61 in a recess 63 formed in the connecting element 62.

An eccentric member 67 is disposed parallel to the threaded spindle 56 and has a shank 66 which passes through a bore 68 in the connecting element 62. At one end thereof the shank 66 has a journal 69 while at the other end thereof it has a head 71 provided with a screwdriver slot, the journal 69 and the head 71 being disposed a few tenths of a millimeter eccentrically to the shank 66 and being mounted so that the member 67 can be rotated. By rotating the eccentric member 67, the connecting element 62 is moved in the direction of the outer circumference of the internally threaded bushing 61 because of the eccentricity of the shank 66 relative to the axis of rotation of the journal 69 and the head 71. This makes it possible for the connecting element 62' to be pressed onto the internally threaded bushing 61 thereby achieving the aforementioned frictional locking to prevent the otherwise unavoidable play between the spindle 56 and the bushing 61 from affecting the precision of the adjustment of the mechanism 11. As can also be seen from FIG. 3, the connecting element 62 has on its bottom end a radially projecting driver pin 72 which indirectly is in or can be brought into an operative connection with the two adjusting ledges 36 and 37.

Between the driver pin 72 and lower edges 73 of the two adjusting ledges 36 and 37, a correction member or block 74 and an additional member or block 76 are disposed. The correction block 74 is provided in order to compensate for the manufacturing tolerances which are inherent to the mechanism. On the flat knitting machine which is to be fitted with the adjusting mechanism 11, the vertical distance between the driver pin 72 in zero position and the fitting pin 51 on the carriage 14 (or the bore in the driving unit 39 into which this pin 51 fits) is measured, and according to the deviation from the desired value a correction block 74 of suitable size is selected and fixed on the connecting element 62. In contrast, the additional block 76 (which is held so that it can be interchanged) serves to adapt the adjusting mechanism and more particularly the driving unit 39 thereof to differing degrees of fineness of the knitting or of the needles used in the knitting machine. Depending on the selected fineness, a larger or smaller stroke range or a transposing of the stroke range upwards or downwards is necessary for the stitch cams 12 and 13. This is achieved by using a longer or a shorter additional block 76, which results only in a parallel displacement of the zero position to be set directly on the driving unit 39. This is achieved by using a longer or a shorter additional block 76, which results only in a parallel displacement of the zero position to be set directly on the driving unit 39. This parallel displacement can however be considered without altering the zero position.

Movement of the internally threaded bushing 61 and hence the connecting element 62 is limited both upwardly and downwardly. The lowermost limit is defined by a stop pin 81 which projects radially from the motor shaft in the region of the connecting sleeve 54, and also by a stop projection 82 which projects from the internally threaded bush 61 downwardly in an axial direction. When the bushing 61 approaches the region of its lowermost movement limit, the projection 82 becomes disposed in the peripheral path of movement of the pin 81 so that the latter then comes up against the projection 82 in a peripheral direction. The spatial positioning of the pin 81 and the projection 82 is such that, at the end of the penultimate revolution of the shaft 53 prior to the bushing 61 reaching its lowermost position, the pin 81 can just still move beneath the projection 82.

The upper limit of movement of the bushing 61 and the adjusting element 62 is determined by the internally threaded bushing 61 becoming disengaged from the external threading on the spindle 56 when the maximum stroke is reached. This means that the external threading terminates at a certain distance from the end of the spindle 56 which is held in the bearings 58 and 59. In order to ensure a simple rethreading of the bushing 61 onto the threading of the spindle 56 when the stepping motor 38 is turned backwards, a pressure spring 83 is provided in the path of the connecting element 62 so that it becomes engaged by the element 62 as the bushing 61 approaches its maximum stroke. In the illustrated construction, the spring 83 surrounds the shank 66 of the eccentric member 67 with one end thereof supported on the housing 52: as an alternative, however, the spring 83 could surround the threaded spindle 56. The pressure spring 83 is of such a length that it is compressed to a certain degree even before the bushing 61 becomes unthreaded from the spindle 56, so that the counter-pressure produced by the spring 83 after the bushing 61 has become unthreaded, exerts an axial force on the bushing to encourage rethreading to take place.

Figure 5:
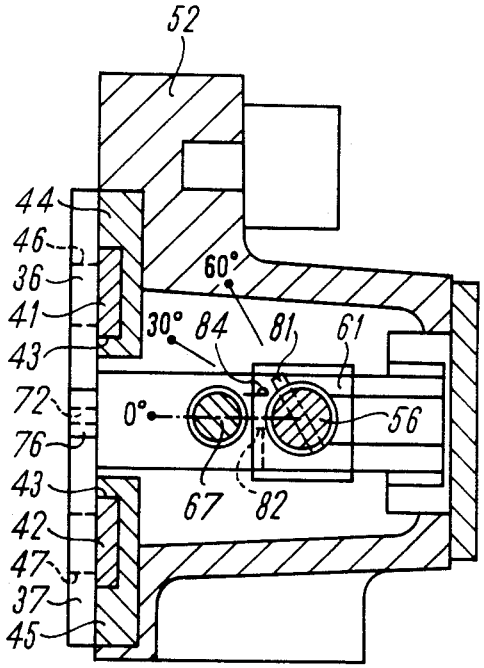
FIG. 5 is a section taken along the line V—V in FIG. 3.

In FIG. 5, the zero point setting of the driving unit 39 is shown. The stepping motor 38 is a four-phase stepping motor which executes 24 steps per complete revolution of 360°, i.e. the drive shaft thereof moves 15° per step. The individual phases of the motor 38 are driven alternately with a pulse so that the individual phases in alternation move the rotor by 15° per pulse. In the region of the lowermost limit of movement of the bushing 61 a microswitch 84 is provided: this microswitch is operated when an angle of less than 60° (e.g. 30° or two steps) remains between the stop pin 81 and the projection 82.

At the same time, one of the phases of the stepping motor is chosen to define the end or zero position. The zero point setting is performed such that, when moving towards the zero point position, each time the chosen phase of the stepping motor 38 is in operation, a determination is made whether or not the microswitch 84 is closed. If the microswitch is not closed, then the motor is moved further. If, on the other hand, the microswitch is closed then the motor 38 is shut off because the zero point position has been reached. The switching time of the microswitch 84 can therefore vary within the above-mentioned remaining angle of rotation without altering the zero position. In this way, the zero point of the driving unit 39 is reproducible at any time, even after the bushing 61 has become unthreaded from the spindle 56.

Since each of the stitch cams 12 and 13 is spring-loaded, that is it can move in an upward direction also during operation, vibrations can occur which knock the spindle 56 and the shaft 53 of the stepping motor 38. In order to protect the bearings and the rotor of the stepping motor 38 from damage, on the one hand the radial bearing 58 which supports the threaded spindle 56 is mounted in the housing 52, and on the other hand a pressure spring is provided which, inside the housing of the stepping motor, encircles the drive shaft 53 and prestresses this so that inside the motor 38 the armature cannot hit against the thrust bearing provided there.

We claim:

1. In a knitting machine having a carriage movable along a needle bed through successive strokes, a pair of stitch cams adjustably supported by said carriage to trail behind a needle cam, mounted on said carriage, during alternate ones of said carriage strokes, respectively, and an adjusting mechanism including a stepping motor operative to adjust each of said stitch cams relative to said carriage at a beginning of the respective carriage stroke, the improvement comprising said adjusting mechanism including said stepping motor also being operative during the stroke of said carriage to adjust the trailing one of said stitch cams.

2. In a knitting machine having a carriage movable along a needle bed through successive strokes, a pair of stitch cams adjustably supported by the carriage to trail behind a needle cam, mounted on the carriage, during alternate ones of the carriage strokes, respectively, and an adjusting mechanism including a stepping motor operative to adjust each of the stitch cams relative to the carriage at a beginning of the respective carriage stroke, the improvement comprising a guide arrangement to guide the stitch cams during adjustment relative to the carriage, wherein:

said adjusting mechanism including said stepping motor also being operative to adjust the trailing one of the stitch cams during each said carriage stroke; and said guide arrangement includes for each of the stitch cams an inclined guide slot in said carriage, a guide peg mounted on the stitch cam and slidably engaged in the guide slot, an adjusting ledge driven by the stepping motor for movement at an angle to the guide slot, biasing means urging the guide peg into engagement with the adjusting ledge, a lever on which the guide peg is mounted, and an axle supporting the lever for rotation relative to the carriage, said axle being disposed parallel to said guide peg.

3. The adjusting mechanism according to claim 2, wherein said guide peg has a side facing away from said adjusting ledge, and said lever is disposed on said side of said guide peg.

4. The adjusting mechanism according to claim 3, wherein said adjusting ledge is movable vertically by said stepping motor.

5. The adjusting mechanism according to claim 2, wherein a pair of said adjusting ledges are provided and are movable in mutually parallel directions by said stepping motor, each of said adjusting ledges being associated with a respective one of said stitch cams, and further comprising a movable driving element connected to said stepping motor, said driving element being disposed between said adjusting ledges to act thereon.

6. The adjusting mechanism according to claim 5, wherein said stepping motor has a rotatable drive spindle which includes an externally threaded portion, and an internally threaded bushing is engaged with said threaded portion for axial movement along said drive spindle upon rotation thereof, said bushing being positively connected without great play to said driving element.

7. The adjusting mechanism according to claim 6, wherein said driving element comprises a rotatable eccentric member and a slide part which is moved towards and away from an outer periphery of said bushing by rotation of said eccentric motor.

8. The adjusting mechanism according to claim 7, wherein said eccentric member is composed of a shank and a pair of journals provided at ends of said shank respectively, said shank being disposed eccentrically with respect to said journals and engaging said slide part.

9. The adjusting mechanism according to claim 5, further comprising an intermediate member held in interchangeable fashion between said driving element and said ajusting ledges.

10. The adjusting mechanism according to claim 5, further comprising a correction member disposed between said driving element and said adjusting ledges, said correction member being firmly connected to said driving element.

11. The adjusting mechanism according to claim 5, further comprising a stop device to define a lowermost position of said driving element.

12. The adjusting mechanism according to claim 6, further comprising a stop device to define a lowermost position of said bushing, said stop device being composed of a projection extending axially from said bushing and a pin projecting radially from said drive spindle, said lowermost position being defined by said projection lying in a path of revolution of said pin.

13. The adjusting mechanism according to claim 12, wherein said externally threaded portion of said drive spindle has screw threads of a predetermined pitch, and said projection and said pin are separated axially of said drive spindle by a distance corresponding to an integral multiple of said predetermined pitch each time said pin becomes axially aligned with said projection.

14. The adjusting mechanism according to claim 5, further comprising limiting means to define an uppermost limit on movement of said driving element.

15. The adjusting mechanism according to claim 6, further comprising limiting means to define an uppermost limit on movement of said bushing, said limiting means including a pressure spring which is compressed when said bushing becomes unthreaded from said threaded portion of said drive spindle.

16. The adjusting mechanism according to claim 7, further comprising limiting means to define an uppermost limit on movement of said bushing, said limiting means including a pressure spring which encircles said eccentric member, said pressure spring being compressed when said bushing becomes unthreaded from said threaded portion of said drive spindle.

17. The adjusting mechanism according to claim 2, wherein said stepping motor is a multiphase motor.

18. The adjusting mechanism according to claim 17, wherein said multi-phase motor has a multiplicity of phases including a selected phase, said motor being operable through successive steps by energisation of said phases, and further comprising a control to arrest operation of said motor at a zero position of each said stitch cam, said control including a microswitch which is operated when said motor is a few steps away from said zero position and means to de-energise said motor in response to operation of said microswitch when said selected phase is energised.

19. The adjusting mechanism according to claim 2, wherein said stepping motor has a drive shaft, and further comprising a spindle firmly secured to said drive shaft, a radial bearing supporting said spindle, and a pressure spring acting on said radial bearing to prestress said radial bearing.

* * * * *